US010280917B2

(12) United States Patent
Sun

(10) Patent No.: US 10,280,917 B2
(45) Date of Patent: May 7, 2019

(54) RECIPROCATING LOW-SPEED HEAVY-LOAD HYDRAULIC PUMP WITH VARIABLE ACTION AREA

(71) Applicant: Wei Sun, Hangzhou (CN)

(72) Inventor: Wei Sun, Hangzhou (CN)

(73) Assignee: ZHEJIANG HAIJU TECHNOLOGY CO., LTD., Hangzhou (CN)

( * ) Notice: Subject to any disclaimer, the term of this patent is extended or adjusted under 35 U.S.C. 154(b) by 516 days.

(21) Appl. No.: 14/430,748

(22) PCT Filed: Sep. 25, 2012

(86) PCT No.: PCT/CN2012/081886

§ 371 (c)(1),
(2) Date: Jul. 15, 2015

(87) PCT Pub. No.: WO2014/047769

PCT Pub. Date: Apr. 3, 2014

(65) Prior Publication Data

US 2015/0354557 A1 Dec. 10, 2015

(51) Int. Cl.
*F04B 49/18* (2006.01)
*F04B 53/14* (2006.01)
(Continued)

(52) U.S. Cl.
CPC ..... *F04B 49/18* (2013.01); *F03G 7/08* (2013.01); *F04B 3/00* (2013.01); *F04B 5/02* (2013.01);
(Continued)

(58) Field of Classification Search
CPC .. F03G 7/08; F04B 23/06; F04B 49/22; F04B 53/14; F04B 5/02; F04B 9/113;
(Continued)

(56) References Cited

U.S. PATENT DOCUMENTS 3,824,896 A * 7/1974 Tull, III ..... B28B 11/14 91/404
4,919,597 A * 4/1990 Kistner ..... F04B 9/113 417/403
(Continued)

FOREIGN PATENT DOCUMENTS

CN 85100434 A 10/1986
CN 1417487 A 5/2003
(Continued)

OTHER PUBLICATIONS

International Search Report for PCT/CN2012/081886 dated Jun. 20, 2013.

*Primary Examiner* — Dominick L Plakkoottam
(74) *Attorney, Agent, or Firm* — Gokalp Bayramoglu

(57) ABSTRACT

A reciprocating low-speed heavy-load hydraulic pump with a variable action area comprises a plurality of hydraulic cylinder units (3) and moving members (1, 2). Two ends of the hydraulic cylinder units (3) are separately connected with the moving members (1, 2) via mechanical structures. The moving members (1, 2) move relative to each other. The hydraulic cylinder unit (3) consists of a hydraulic cylinder (4), a reversing valve (5) and a one-way valve (6). The hydraulic cylinder (4), the reversing valve (5) and the one-way valve (6) are connected with each other via hydraulic pipelines. Based on different magnitudes of driving force, the hydraulic pump can proactively configure and form different combinations of hydraulic cylinder units, and further adjust the size of an equivalent action area. Therefore, even if the magnitude of the driving force changes, it can be ensured that the hydraulic pump consisting of hydraulic cylinder units outputs oil liquid with a relatively stable pressure for use by a subsequently connected system. The reciprocating low-speed heavy-load hydraulic pump with a
(Continued)

variable action area is advantageous in high conversion efficiency, a simple system structure and good working stability.

7 Claims, 3 Drawing Sheets

(51) Int. Cl.

| | |
|---|---|
| ***F04B 53/10*** | (2006.01) |
| ***F04B 53/16*** | (2006.01) |
| ***F04B 7/00*** | (2006.01) |
| ***F04B 23/06*** | (2006.01) |
| ***F03G 7/08*** | (2006.01) |
| ***F04B 3/00*** | (2006.01) |
| ***F04B 5/02*** | (2006.01) |
| ***F04B 9/02*** | (2006.01) |
| ***F04B 49/22*** | (2006.01) |
| ***F04B 49/24*** | (2006.01) |

(52) U.S. Cl.
CPC ..... *F04B 7/0076* (2013.01); *F04B 9/02* (2013.01); *F04B 23/06* (2013.01); *F04B 49/22* (2013.01); *F04B 49/24* (2013.01); *F04B 49/246* (2013.01); *F04B 53/10* (2013.01); *F04B 53/14* (2013.01); *F04B 53/16* (2013.01)

(58) Field of Classification Search
CPC ..... F15B 1/02; F15B 2211/20546; F15B 2211/20569; F15B 2211/411; F15B 2211/428; F15B 2211/55; F15B 2211/6313; F15B 2211/7107
See application file for complete search history.

(56) References Cited

U.S. PATENT DOCUMENTS

| | | | | |
|---|---|---|---|---|
| 4,928,487 | A * | 5/1990 | Nikolaus | F15B 1/02 60/414 |
| 8,186,154 | B2 * | 5/2012 | Nelson | E02F 9/2217 60/414 |

FOREIGN PATENT DOCUMENTS

| | | | |
|---|---|---|---|
| CN | 1740557 | A | 3/2006 |
| CN | 101354052 | A | 1/2009 |
| CN | 201730780 | U | 2/2011 |
| CN | 102068136 | A | 5/2011 |
| JP | 2003004006 | A | 1/2003 |

* cited by examiner

RECIPROCATING LOW-SPEED HEAVY-LOAD HYDRAULIC PUMP WITH VARIABLE ACTION AREA

FIELD OF THE INVENTION

The present invention relates to an oil pump, and specifically to a reciprocating low-speed heavy-load hydraulic pump with variable action area.

BACKGROUND OF THE INVENTION

In a wide variety of hydraulic pumps, a positive displacement pump is one typical representative type of pump. The pump periodically transfers energy to liquid so as to pressurize the liquid thereby forcedly discharging the liquid by means of periodically changing a sealed working space volume for containing liquid. The discharged oil flow has a value depending on the change of the volume of the sealed chamber. Two requirements for work are necessary as follows: 1) the sealed volume changes periodically, wherein the oil is sucked when the sealed volume increases, and the oil is pressurized when the sealed volume decreases; 2) an oil dispensing device is provided for ensuring that the sealed volume is only in communication with an oil suction pipe when the sealed volume increases and is only in communication with an oil discharge pipe when the sealed volume decreases.

The traditional positive displacement pump generally needs to be rotated by a mover with a relatively high rotating speed. However, the traditional positive displacement pump is not applied in case of a reciprocating drive and a relatively low operating speed.

SUMMARY OF THE INVENTION

The technical problem to be solved in the present invention is to provide a reciprocating low-speed heavy-load hydraulic pump with variable action area for the operating condition of a reciprocating drive and a relatively low operating speed.

The present invention can be achieved by the following technical solution:

A reciprocating low-speed heavy-load hydraulic pump with variable action area comprises a plurality of sets of hydraulic cylinder units (3), a moving member (1), and a moving member (2), characterized in that each of the hydraulic cylinder units (3) has two ends connected with the moving member (1) and the moving member (2) via mechanical structures, respectively, the moving member (1) and the moving member (2) move relatively to each other, each of the hydraulic cylinder units (3) consists of a hydraulic cylinder (4), a reversing valve (5) and a one-way valve (6) connected with each other via hydraulic pipelines.

When the reversing valve (5) is in a control position, an oil port A is in communication with an oil port B, and when it is not in the control position, the oil port A is not in communication with the oil port B.

The reversing valve (5) is in the form of a two-position two-way solenoid reversing valve (5'), and the oil port B is cut off in one direction towards the oil port A.

The reversing valve (5) is in the form of a two-position two-way solenoid reversing valve (5"), and the oil port A and the oil port B are cut off in two directions.

The hydraulic cylinder (4) is in the form of a single-rod piston cylinder (4').

The hydraulic cylinder (4) is in the form of a plunger cylinder (4").

The hydraulic cylinder (4) is in the form of a two-rod piston cylinder (4''').

In operation of the reciprocating low-speed heavy-load hydraulic pump with variable action area, the respective hydraulic cylinder unit (3) controlled by the reversing valve (5) is controlled to participate in pumping oil by switching the reversing valve (5) to various different control position functions. When the number of the hydraulic cylinder units (3) participating in pumping oil decreases, the equivalent action area of the hydraulic pump will decrease; when the number of the hydraulic cylinder units (3) participating in pumping oil increases, the equivalent action area of the hydraulic pump will increase.

Based on different magnitudes of driving force, the present device can actively configure and form different combinations of the hydraulic cylinder units, and can further adjust the size of equivalent action area. In this manner, by changing the size of the equivalent action area of the hydraulic pump, it can be ensured that the hydraulic pump consisting of the hydraulic cylinder units outputs oil with a relatively stable pressure for use of a subsequently connected system, even if the magnitude of the driving force changes. The reciprocating low-speed heavy-load hydraulic pump with variable action area has advantages of high conversion efficiency, a simple system structure, a good working stability, etc.

There is generally a component such as a hydraulic accumulator for stabilizing pressure in the subsequently connected system of the reciprocating low-speed heavy-load hydraulic pump. It is difficult to adapt the output power of the power source to the pressure in the accumulator if the action area is not variable. That is, when the output power of the power source is small so that the hydraulic pump outputs a pressure lower than the accumulator, the hydraulic pump may not work; when the output power of the power source is too high so that the hydraulic pump can output a pressure greatly larger than the accumulator, this may result in many questions such as the hydraulic pump working at a too high speed where there is a waste. Thus, the alternating power of the power source can be fully utilized only when the action area of the hydraulic pump is variable so that the output power of the power source and the output pressure of the hydraulic pump are adapted to the system pressure maintained by the accumulator.

DETAILED DESCRIPTION OF EMBODIMENTS OF THE INVENTION

Figure 1:
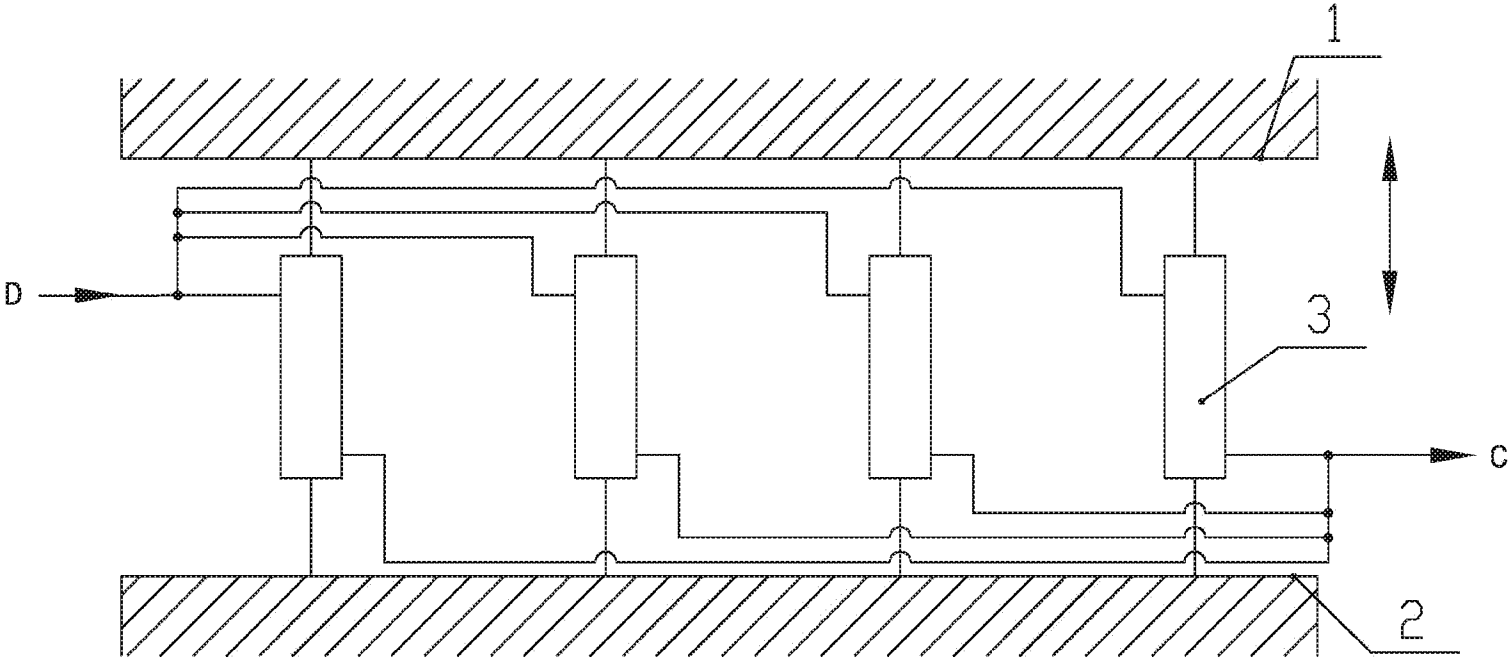
FIG. 1 is a schematic view of the principle of the present invention.

Referring to FIG. 1, a reciprocating low-speed heavy-load hydraulic pump with variable action area comprises a plurality of sets of hydraulic cylinder units (3), a moving member (1), and a moving member (2), characterized in that each of the hydraulic cylinder units (3) has two ends connected with the moving member (1) and the moving member (2) via mechanical structures, respectively, the moving member (1) and the moving member (2) move relatively to each other, each of the hydraulic cylinder units (3) consists of a hydraulic cylinder (4), a reversing valve (5) and a one-way valve (6) connected with each other via hydraulic pipelines.

The operating principle is as follows: there is a relative replacement between the moving member (1) and the moving member (2) under an external force. The hydraulic cylinder units (3) extend and retract reciprocally, suck oil through an oil port D, and converge and output pressure oil through an oil port C. The hydraulic pump can output relatively stable pressure oil by configuring various operation combinations of a different number or different area magnitudes of the hydraulic cylinder units (3) based on different magnitudes of external force.

Figure 2:
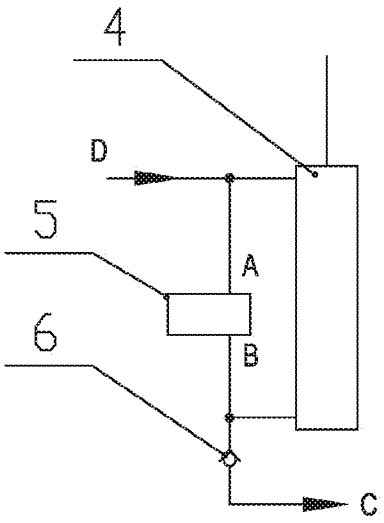
FIG. 2 is a schematic view showing the system principle of the hydraulic cylinder units (3)

Referring to FIG. 2, shown is a schematic view of the system principle of the hydraulic cylinder units (3). Each of the hydraulic cylinder units (3) consists of a hydraulic cylinder (4), a reversing valve (5) and a one-way valve (6) connected with each other via hydraulic pipelines. When the reversing valve (5) is in a control position, an oil port A is in communication with an oil port B, and when it is not in the control position, the oil port A is not in communication with the oil port B.

The operating principle is as follows: when the reversing valve (5) is not in the control position, the oil port A is not in communication with the oil port B. When the hydraulic cylinder (4) retracts, the hydraulic cylinder (4) outputs pressure oil through the one-way valve (6) from the oil port C and simultaneously sucks oil from the oil port D; when the hydraulic cylinder (4) extends, oil is outputted from the oil port D and through the reversing valve (5) to the oil port C and is inputted into the hydraulic cylinder (4). If the inputted hydraulic flow is not enough, the hydraulic cylinder (4) sucks oil from a hydraulic oil tank through the port D and the reversing valve (5). When the reversing valve (5) is in a control position, the oil port A is in communication with the oil port B, and the hydraulic cylinder (4) freely extends and retracts and does not output any pressure oil. The one-way valve (6) is mainly used to ensure that all the pressure oil outputted by the hydraulic cylinder units (3) flows to the same location without mutual interference.

Figure 3:
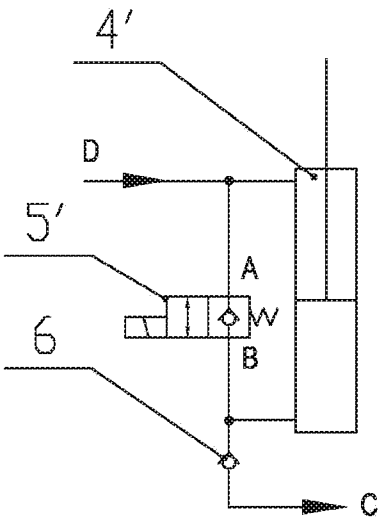
FIG. 3 is a schematic view showing the system principle of a first embodiment of the hydraulic cylinder units (3)

Referring to FIG. 3, shown is a schematic view of the system principle of a first embodiment of the hydraulic cylinder units (3). Each of the hydraulic cylinder units (3) mainly consists of a single-rod piston cylinder (4'), a two-position two-way solenoid reversing valve (5') and a one-way valve (6).

The operation is as follows: when the electromagnet is not energized, the two-position two-way solenoid reversing valve (5') works in the right position, and at this time, the oil port B is cut off in one direction towards the oil port A. When the single-rod piston cylinder (4') retracts, the rodless chamber of the single-rod piston cylinder (4') thereof outputs pressure oil through the one-way valve (6) from the oil port C and the rod chamber of the single-rod piston cylinder (4') thereof sucks oil from the oil port D; when the single-rod piston cylinder (4') extends, oil is outputted from the rod chamber of the single-rod piston cylinder (4') and is inputted through the two-position two-way solenoid reversing valve (5') into the rodless chamber of the single-rod piston cylinder (4'). Since the rodless chamber has a different area from the rod chamber, the rodless chamber of the single-rod piston cylinder (4') will have a change of volume larger than the rod chamber, the single-rod piston cylinder (4') also sucks oil from the oil port D through the two-position two-way solenoid reversing valve (5'). When the electromagnet is energized, the two-position two-way solenoid reversing valve (5') works in the left position, the oil port A is in communication with the oil port B, the rod and rodless chambers of the single-rod piston cylinder (4') communicate with each other and both are in communication with the oil port D. At this time, the single-rod piston cylinder (4') freely extends and retracts and does not output any pressure oil.

Figure 4:
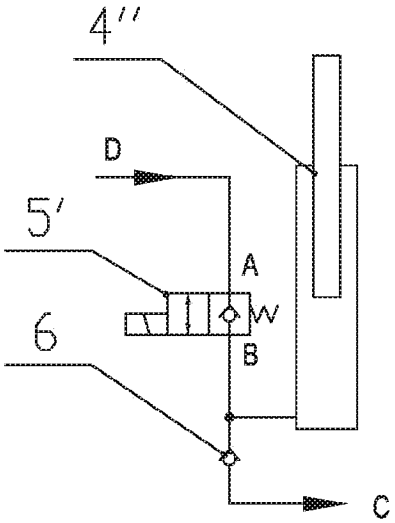
FIG. 4 is a schematic view showing the system principle of a second embodiment of the hydraulic cylinder units (3)

Referring to FIG. 4, shown is a schematic view of the system principle of a second embodiment of the hydraulic cylinder units (3). Each of the hydraulic cylinder units (3) mainly consists of a plunger cylinder (4"), a two-position two-way solenoid reversing valve (5') and a one-way valve (6).

The operation is as follows: when the electromagnet is not energized, the two-position two-way solenoid reversing valve (5') works in the right position, and at this time, the oil port B is cut off in one direction towards the oil port A. When the plunger cylinder (4") retracts, the plunger cylinder (4") outputs pressure oil through the one-way valve (6) from the oil port C; when the plunger cylinder (4") extends, the plunger cylinder (4") sucks oil through the two-position two-way solenoid reversing valve (5') from the oil port D. When the electromagnet is energized, the two-position two-way solenoid reversing valve (5') works in the left position, the oil port A is in communication with the oil port B, the plunger cylinder (4") is in communication with the oil port D. At this time, the plunger cylinder (4") freely extends and retracts and does not output any pressure oil.

Figure 5:
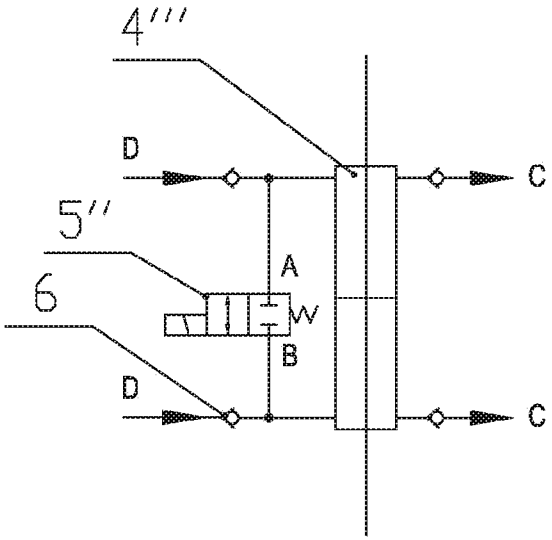
FIG. 5 is a schematic view showing the system principle of a third embodiment of the hydraulic cylinder units (3).

Referring to FIG. 5, shown is a schematic view of the system principle of a third embodiment of the hydraulic cylinder units (3). Each of the hydraulic cylinder units (3) mainly consists of a two-rod piston cylinder (4"), a two-position two-way solenoid reversing valve (5") and a one-way valve (6).

The operation is as follows: when the electromagnet is not energized, the two-position two-way solenoid reversing valve (5") works in the right position, and at this time, the oil port A and the oil port B are cut off in two directions. When the two-rod piston cylinder (4''') moves downward, the lower chamber of the two-rod piston cylinder (4''') thereof outputs pressure oil through the one-way valve (6) from the oil port C, and the upper chamber of the two-rod piston cylinder (4''') thereof sucks oil through the one-way valve (6) from the oil port D; when the two-rod piston cylinder (4''') moves upward, the lower chamber of the two-rod piston cylinder (4''') sucks oil through the one-way valve (6) from the oil port D, and the upper chamber of the two-rod piston cylinder (4''') outputs pressure oil through the one-way valve (6) from the oil port C. When the electromagnet is energized, the two-position two-way solenoid reversing valve (5") works in the left position, the oil port A is in communication with the oil port B, both the upper and lower chambers of the two-rod piston cylinder (4''') are in communication with the oil port D through the one-way valve (6). At this time, the two-rod piston cylinder (4''') freely extends and retracts and does not output any pressure oil. If there is oil leakage loss during freely extending and retracting, oil is supplied into the system through the one-way valve (6) from the oil port D.

The invention claimed is:

1. A reciprocating low-speed heavy-load hydraulic pump with variable action area comprising a set of hydraulic cylinder units, a first moving member, and a second moving member, wherein each of the hydraulic cylinder units has two ends, one of the two ends is connected to the first moving member and the other of the two ends is connected to the second moving member via mechanical structures, the hydraulic cylinder units extend and retract to form a relative displacement between the first moving member and the second moving member under an external force, and each of the hydraulic cylinder units includes a respective hydraulic cylinder, a respective reversing valve and a respective one-way valve connected with each other via hydraulic pipelines.

2. The reciprocating low-speed heavy-load hydraulic pump with variable action area according to claim 1, wherein when the reversing valve is in a control position, an oil port A is in communication with an oil port B, and when it is not in the control position, the oil port A is not in communication with the oil port B.

3. The reciprocating low-speed heavy-load hydraulic pump with variable action area according to claim 2, wherein the reversing valve is in the form of a two-position two-way solenoid reversing valve, and that the oil port B is cut off in one direction towards the oil port A.

4. The reciprocating low-speed heavy-load hydraulic pump with variable action area according to claim 2, wherein the reversing valve is in the form of a two-position two-way solenoid reversing valve, and that the oil port A and the oil port B are cut off in two directions.

5. The reciprocating low-speed heavy-load hydraulic pump with variable action area according to claim 1, wherein the hydraulic cylinder is in the form of a single-rod piston cylinder.

6. The reciprocating low-speed heavy-load hydraulic pump with variable action area according to claim 1, wherein the hydraulic cylinder is in the form of a plunger cylinder.

7. The reciprocating low-speed heavy-load hydraulic pump with variable action area according to claim 1, wherein the hydraulic cylinder is in the form of a two-rod piston cylinder.

* * * * *